US009516905B2

(12) United States Patent
Pagnon

(10) Patent No.: US 9,516,905 B2
(45) Date of Patent: Dec. 13, 2016

(54) BRA

(76) Inventor: Roberta Pagnon, Bessica di Loria (IT)

( * ) Notice: Subject to any disclaimer, the term of this patent is extended or adjusted under 35 U.S.C. 154(b) by 274 days.

(21) Appl. No.: 14/232,876

(22) PCT Filed: Jul. 18, 2012

(86) PCT No.: PCT/IB2012/053662

§ 371 (c)(1),
(2), (4) Date: Jan. 14, 2014

(87) PCT Pub. No.: WO2013/011467

PCT Pub. Date: Jan. 24, 2013

(65) Prior Publication Data

US 2014/0154949 A1 Jun. 5, 2014

(30) Foreign Application Priority Data

Jul. 18, 2011 (IT) ..... VI2011A0188

(51) Int. Cl.
*A41C 3/10* (2006.01)
*A41C 3/00* (2006.01)

(52) U.S. Cl.
CPC . *A41C 3/10* (2013.01); *A41C 3/00* (2013.01); *A41B 2400/82* (2013.01)

(58) Field of Classification Search
CPC ..... A41C 3/00; A41C 3/06; A41C 3/144; A41C 3/0057; A41C 3/12; A41C 3/126; A41C 3/0014; A41C 3/065
USPC ..... 450/81, 39, 112, 106; 2/237, 236, 221, 2/220
See application file for complete search history.

(56) References Cited

U.S. PATENT DOCUMENTS 2,289,679 A * 7/1942 Porter ..... A41C 3/144 450/57
2,524,620 A * 10/1950 Cadous ..... A41C 3/06 450/41
2,628,356 A * 2/1953 Rosenfield ..... A41C 3/06 450/41
2,988,087 A * 6/1961 Krieger ..... A41C 3/06 450/81
3,254,653 A * 6/1966 Krieger ..... A41C 3/00 450/39
6,332,825 B1 * 12/2001 Henricksen ..... A41C 3/0057 450/1
6,446,268 B1 * 9/2002 Lazarian ..... A41B 11/126 2/237
7,228,809 B2 * 6/2007 Angelino ..... A41D 27/245 112/440
7,422,508 B2 * 9/2008 Bentham ..... A41C 3/0014 2/243.1
7,645,916 B2 * 1/2010 Rasor ..... A61L 15/60 442/123

(Continued)

FOREIGN PATENT DOCUMENTS

DE 10112251 10/2002
EP 1770196 4/2007

*Primary Examiner* — Gloria Hale
(74) *Attorney, Agent, or Firm* — Themis Law

(57) ABSTRACT

A brassiere includes an elastic band, a pair of cups (and a pair of elongated flexible support elements configured to come at least partly into contact with the shoulders of the user. Each of the cups includes an outer surface and an inner surface made of a first textile material which includes a plurality of first inserts in a first flexible polymeric material having a coefficient of friction with the skin greater than the first textile material.

19 Claims, 2 Drawing Sheets

(56) References Cited

U.S. PATENT DOCUMENTS

| | | | | |
|---|---|---|---|---|
| 8,684,789 | B2 * | 4/2014 | Gramelspacher | A41C 3/065 450/81 |
| 2003/0040256 | A1 * | 2/2003 | Waitz | A41C 3/12 450/86 |
| 2003/0186620 | A1 * | 10/2003 | Kaye | A41F 15/005 450/86 |
| 2005/0020184 | A1 * | 1/2005 | Izcoa | A41F 15/007 450/86 |
| 2005/0266770 | A1 | 12/2005 | Hendricksen | |
| 2006/0223415 | A1 * | 10/2006 | Watrin | A41C 3/0014 450/39 |
| 2011/0143633 | A1 | 6/2011 | Zhang | |
| 2012/0225607 | A1 * | 9/2012 | Martinet | A41C 3/126 450/41 |

* cited by examiner

20'
42
45
$S_3$
27'
Y
27
22
44
28
43
$S_1$

20'
42
45
$S_3$
27
28'
28
22
44
43
$S_1$

20'
42
45
$S_3$
27'
22
44
28'
43
$S_1$
27
Y
28

10
17
X
17'
13'
17''''
30'
13
17''
13''
h
$S_2$

BRA

FIELD OF THE INVENTION

The present invention is generally applicable to the technical field of clothing, and particularly relates to a bra.

BACKGROUND OF THE INVENTION

Garments suitable to support and contain the female breast are known, such as brassieres, corsets or the like.

Generally, these garments comprise a band designed to encircle the thorax, a pair of cups for the breasts and a pair of flexible elongated support elements, called "straps". These can be adjusted in length to adapt the brassiere to the user who wears it.

These known garments, generally at least partially made of a natural or synthetic fabric, give a poor support to a voluminous breast which tends to fall downwards by gravity.

For this purpose, special bras are known, called "push-up", suitable to lift the female breast. However, these known brassieres give the breast an unnatural appearance and have a plurality of seams on the cup, which are unsightly, for example in case of use of tight fitting clothing.

Also known are special bras and similar clothing articles designed to minimize the movement of the breast during sports practice. For this purpose, the base material of such brassieres is relatively inelastic.

Examples of such bras are known from US2009081924 and US2005266770, which disclose bras with cups having inserts made of high-friction polymeric material in contact with the skin. The second document US2005266770 further describes a non-sports bra, the cups of which do not include anti-friction inserts, as well as a strapless top that includes such inserts.

However, these known brassieres give the breast an unnatural appearance, since the restraining structure of the bra tends to compress it.

From documents US2011143633, EP1770196 and DE10112251 bras are known which include inserts in polymeric material.

SUMMARY OF THE INVENTION

Object of the present invention is to at least partially overcome the above described drawbacks by providing a bra suitable to support the breasts while maintaining natural appearance and volume.

Another object of the invention is to provide a bra which prevents the breast from sliding downwards inside the cup.

Another object of the invention is to provide a bra that is also aesthetically pleasing even if one wears tight clothing.

Another object of the invention is to provide a bra that allows good transpiration of the skin with which it is in contact.

These and other objects, as better explained hereafter, are fulfilled by a bra having one or more of the features described herein and/or claimed and/or illustrated, Advantageous embodiments of the invention are defined in the following c.

BRIEF DESCRIPTION OF THE DRAWINGS

Further features and advantages of the invention will become more apparent from the detailed description of some preferred, non-exclusive embodiments of a brassiere according to the invention, which are described as non-limiting examples with the help of the annexed drawings, in which.

DETAILED DESCRIPTION OF SOME PREFERRED EMBODIMENTS OF THE INVENTION

Figures 1, 2, 3:
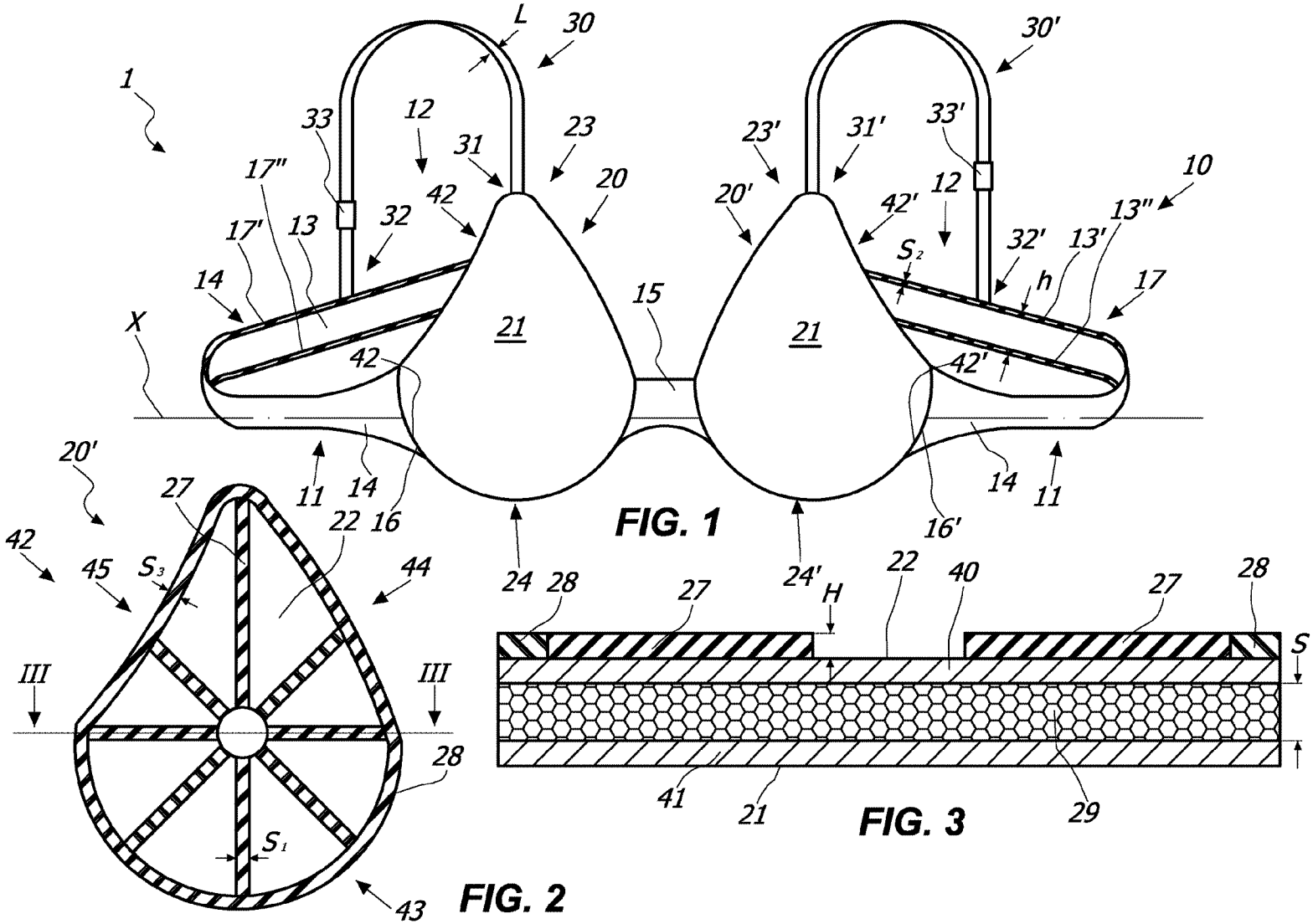
FIG. 1 is a front view of an embodiment of the bra 1, wherein an elastic band 10 has on the inner surface 13 second linear elements 17', 17" consisting of respective continuous strips of a second polymeric material.
FIG. 2 is a front view of the inner surface 22 of a first embodiment of the cup 20 of the bra 1, wherein the first linear elements 27 as well as the third linear element 28 consist of continuous strips respectively of a first and a third polymeric material.
FIG. 3 is a sectional view of the cup 20 taken along a plane III-III in FIG. 2.

Referring to the above figures, the brassiere according to the invention, generally indicated with 1, is designed to be worn by female users. Appropriately, the brassiere 1 may be configured and/or dimensioned to support the breast while maintaining its natural appearance and/or form.

As used herein, the expression "bra" and derivatives thereof is intended to indicate a garment suitable to support the female breast, regardless of its use or its configuration.

Therefore, the bra in accordance with the present invention may be an undergarment to be normally worn below the clothes as linen, or may be an integral part of a garment, for example a bra part of a bodice of a gown.

On the other hand, the bra in accordance with the present invention may be a swimsuit, to be worn for example at the beach or at the pool.

The bra 1 has various parts or elements identical to each other or anyway substantially similar. In particular, the bra 1 has several pairs of parts. Unless otherwise specified, those parts or elements are described individually and/or indicated with a single number, being understood that the described and/or illustrated features are common to all the other parts or identical or anyway substantially similar elements.

For clarity purposes, in the figures these parts may be indicated with the same number, possibly followed by a simple or double apex. The absence of this notation is not to be in any way intended as any difference between the technical features of the parts or of elements which are identical to each other or anyway substantially similar.

The bra 1 according to the invention may include an elastic band 10 susceptible to surround the thorax of a user, a pair of cups 20 for the breasts and a pair of elongated flexible support elements 30, also known as "straps", destined to come at least partially in contact with the shoulders of the user.

The elastic band 10 may include a front area 11 destined to come in contact with the chest of the user, generally in the lateral area thereof, and a rear zone 12 destined to come into contact with the back of the user. In particular, the elastic band 10 may include an inner surface 13 designed to come into contact with the skin of the chest and/or of the back of the user and an outer surface 14 which may remain visible when not covered by clothing or other.

As per se known, the elastic band 10 may include closing means, such as one or more hook elements, placed in correspondence of the rear region 11 and/or with the front region 12, preferably in a central position.

The embodiment of the bra 1 shown in FIG. 1, for example, may include the closing means in correspondence of the rear zone 11 of the elastic band 10.

Conveniently, between the two cups 20 a central band 15 may be interposed for the connection thereof. Generally, such portion may be made of a natural, artificial or mixed fabric, and may be slightly elastic.

Preferably, the brassiere 1 may be configured to avoid the typical compressive effect of the so-called "push-up" brassiere. For this purpose, the central band 15 may have a sufficient extension to avoid, once the bra is worn, the mutual lateral compression of the breasts.

Moreover, each cup 20 of the bra 1 may include a rigid or semirigid insert, usually called the "underwire", in particular in the area below the breast.

Moreover, the dimensions of the cups 20 may be such to cover almost completely the breast, in its lower area as well as in the upper one. In particular, the dimensions of the cups 20 may be such as to cover the last area for more than half of its surface extension.

The two cups 20, which may include an outer surface 21 susceptible to remain visible when not covered by clothing or other and an inner surface 22 susceptible to come into contact with the skin of the breast, may be connected to the elastic band 10.

In particular, each cup 20 may present an upper portion 23 connected to the elastic band 10 in correspondence of the rear zone 12 thereof and a lower portion 24 connected to the elastic band 10 in correspondence of the front area 11 thereof.

This last connection, as per se known, may take place by means of appropriate seams which join the lower peripheral and/or side edge 28 of each cup 20 with a corresponding peripheral edge 16 of the elastic band 10.

As per se known, the connection between the upper portions 23 of the cups 20 and the elastic band 10 may take place by means of the elongated flexible support elements 30. In particular, each of these may include a first end 31 connected to the upper portion 23 of the respective cup 20 and a second end 32 connected to the elastic band 10 in correspondence of the rear zone 12.

In this way, the elongated flexible support elements 30 help to support the breast, unloading the weight thereof on the shoulder of the user and/or on the elastic band 10.

Advantageously, the two support elements 30 may include means for adjusting the length thereof, such as a slider 33 of the known type or similar adjusting means. By means of the adjusting means 33 it is possible to adapt the bra 1 to the user who wears it, For aesthetic, and/or comfort reasons, once the bra 1 is worn, the two support elements 30 may remain substantially parallel to each other and not reciprocally crossed.

For the same reasons, the two support elements 30 may have a relatively small width L in correspondence of the portion designed to interact with the shoulder of the user, preferably less than 30 mm, preferably less than 20 mm and even more preferably less than 15 mm.

The elastic band 10, the cups 20 and the support elements 30 may be made of a textile material, whether synthetic, natural or mixed.

In particular, the inner surfaces 22 and 13 respectively of the cups 20 and of the band 10 may be manufactured in a respective first and second textile material, which may or may not be the same or similar. For example, the first and the second textile material may be a cotton, polyester or blended fabric.

Advantageously, the inner surface 22 of each cup 20 may include one or more first inserts 27 made of a first flexible polymeric material having a coefficient of friction with the skin higher than the one of the first textile material in which the inner surface 22 of each cup 20 is made of.

The brassiere 1 may include a single first insert 27, which may have any shape and may completely or partially occupy the inner surface 22 of each cup 20.

The shape and/or size of the inserts may take into account the need to have a good friction effect on the skin and needs of local transpiration of the skin.

Preferably, the bra 1 may include a plurality of first inserts 27, which may be distributed over the entire inner surface 22 of each of the cups 20, although they will not be coextensive with it.

This means that the first inserts 27 may be preferably not concentrated only in one area of the cup 20, as taught by the documents US20110143633 or DEI0112251, but may be distributed over substantially the entire inner surface 22 of the cup 20.

However, it is understood that the first inserts 27 may not completely occupy the inner surface 22 of the cups 20. In fact, the ratio between the area occupied by the inserts 27 and the total inner area 22 of the cup 20 may be such as to ensure a good friction effect on the skin and good local transpiration of the skin.

For this purpose, the area occupied by the first inserts 27 may be between 10% and 70% of the total inner surface 22 of each cup 20, preferably between 10% and 40% of the total inner surface 22 of each cup 20 and even more preferably between 15% and 35% of the total inner surface 22 of each cup 20.

More particularly, in a summer bra the surface occupied by the first inserts 27 may be between 20% and 40% of the total inner surface 22 of each cup 20, whereas in a winter bra the surface occupied by the first inserts 27 may rise up to 50% or 60% of the total inner surface 22 of each cup 20.

Appropriately, moreover, the rear zone 12 of the elastic band 10 may be sized and/or configured to minimize the movement thereof with respect to the back of the user.

For this purpose, the rear zone 12 may have a minimum height h greater than 30 mm, preferably greater than 40 mm and even more preferably greater than 50 mm.

As used herein, where the maximum or minimum size of one or more elements is indicated, it is intended to mean the size of each element taken at the point where the size is maximum or minimum.

Therefore, if the element has a constant size, the maximum or minimum size may be taken at any point thereof, if, vice versa, the element has variable dimension, the maximum or minimum size should be taken at the point where the size is maximum or minimum.

Furthermore, the inner surface 13 of the elastic band 10 may preferably include one or more second inserts 17 in a second flexible polymeric material having a coefficient of friction with the skin greater than that of the second textile material in which the same inner surface 13 is made.

The brassiere 1 may include a single second insert 17, which may have any shape and may occupy totally or partially the inner surface 13 of the elastic band 10.

Preferably, however, the inner surface 13 of the elastic band 10 may include a plurality of second inserts 17, whose shape and/or size may preferably take into account the need to have a good effect of friction on the skin and the need of local transpiration of the skin.

For this purpose, the area occupied by the second inserts 17 may be between 5% and 50% of the total inner surface 13 of the elastic band 10, preferably between 10% and 50% of the total inner surface 13 of the elastic band 10 and even more preferably between 20% and 40% of the total inner surface 13 of the elastic band 10.

The total amount of the first polymeric material in the cup 20, understood as the surface occupied by the first inserts 27 with respect to the total inner surface 22 of each cup 20, and of the second polymeric material on the elastic band 10, understood as the surface occupied by the second inserts 17 with respect to total internal surface 13 of the elastic band 10, depend on the size of the breast to be supported, and then on the bra size. As the size of the breast to be supported increases the total quantity of the first polymeric material in the cup 20 and the second polymeric material on the elastic band 10 also increases.

The first and/or the second polymeric material of which the first inserts 27 and/or the second inserts 17 are made, which may be equal to each other or in any case have the same basis, may have a relatively high flexibility.

Preferably, the flexibility of the first and/or the second polymeric material may be sufficiently high to allow the surfaces of contact with the skin of the user of the first insert 27 and/or of the second inserts 17 to completely adhere to the skin of the user once the bra 1 is worn.

Moreover, the first and/or the second polymeric material of which the first inserts 27 and/or the second inserts 17 are made, may can have a high coefficient of friction with the skin of the user, so as to avoid relative movements between the skin and, respectively, the cups 20 and/or the elastic band 10.

Advantageously, the first and/or the second polymeric material may be chosen from silicones or materials having comparable chemical-physical features. Suitably, the first and/or the second polymeric material may have chemical-physical features which make them suitable for protracted contact with the human skin.

In this way the bra 1, once worn by the user, remains stationary in its original position even after a comparatively long time. In particular, the first inserts 27 and the elastic band 10, and in particular possible second inserts 17 thereof, may act synergistically to lock the position of the breast in the cup, thus avoiding its slipping down within the same.

In order to maximize the stability of the brassiere when worn, the elastic band 10 may have an elasticity measured according to ASTM D 2594 of less than 100%, preferably less than 80% and even more preferably less than 60%.

The first inserts 27 and/or the second inserts 17 may have any shape. Preferably, however, the first inserts 27 may consist of the first linear elements spaced apart from each other lying on the inner surface 22 of each of the cups 20.

Advantageously, the first linear elements 27 may have a first thickness S1 comprised between 1 mm and 10 mm, preferably between 1 mm and 5 mm.

Figures 4, 5, 6, 7:
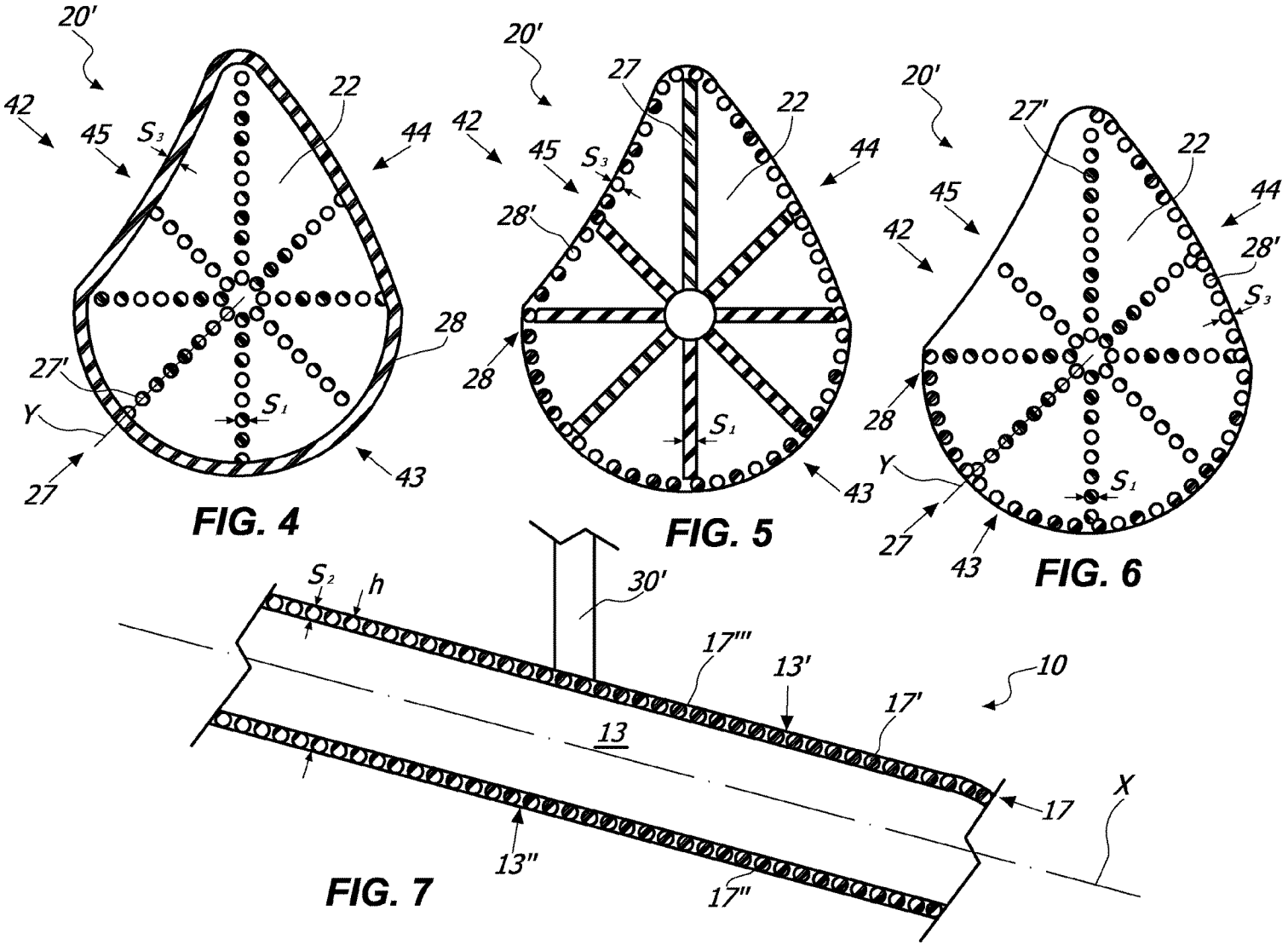
FIG. 4 is a front view of the inner surface 22 of a second embodiment of the cup 20 of the bra 1, wherein the first linear elements 27 are made up of sequences of the first antifriction elements 27' distributed along respective axes Y whereas the third linear element 28 consists of a continuous strip of the third polymeric material extending along the peripheral edge 42.
FIG. 5 is a front view of the inner surface 22 of a third embodiment of the cup 20 of the bra 1, wherein the first linear elements 27 are made up of continuous strips of the first polymeric material while the third linear element 28 is constituted by a sequence of third anti-friction elements 28' distributed along the peripheral edge 42.
FIG. 6 is a front view of the inner surface 22 of a fourth embodiment of the cup 20 of the bra 1, wherein both the first linear elements 27 and the third linear element 28 consist of respective sequences of the first anti-friction elements 27' distributed along respective axes Y and of third anti-friction elements 28' distributed along the peripheral edge 42.
FIG. 7 is an enlarged front view of an embodiment of the elastic band 10 alternative to the one illustrated in FIG. 1, wherein the inner surface 13 has second linear elements 17', 17" consisting of respective sequences of second anti-friction elements 17'".

Appropriately, the first linear elements 27 may consist of first continuous strips of the first flexible polymeric material, as visible in FIG. 2, or of sequences of first anti-friction elements 27 discontinuous with each other distributed along a respective longitudinal axis Y, as illustrated in FIG. 4. In a preferred, non-exclusive embodiment, the first anti-friction elements 27' may have generally circular shape, with a diameter coinciding with the first thickness S1.

To maximize the effect of friction on the skin while allowing a good transpiration thereto, the first linear elements 27, whether formed by continuous strips or sequences of the first anti-friction elements 27' discontinuous with each other, may have a uniform polar distribution around a substantially central point of each of the cups 20, as shown in FIGS. 2 and 4.

In a preferred, non-exclusive embodiment, the second inserts 17 may consist of at least one pair of second linear elements 17', 17" between spaced apart from each other and lying on the inner surface 13 of the elastic band 10, preferably in correspondence of the upper and lower edges 13', 13" thereof, Preferably, the second linear elements 17', 17" may be substantially parallel to each other and with respect to the axis X defined by the elastic band 10. Where appropriate, one or more additional linear elements interposed between the second linear elements 17', 17" may also be provided.

To maximize the friction on the skin while allowing a good transpiration thereto, the second linear elements 17', 17" may have a second thickness S2 comprised between 1 mm and 10 mm, preferably between 1 mm and 5 mm.

Appropriately, the second linear elements 17', 17" may be formed by second continuous strips of the second flexible polymeric material, as shown in the embodiment of FIG. 1, or by sequences of second anti-friction elements 17' discontinuous with each other distributed along the upper and lower edges 13', 13" of the elastic band 10, as shown in the embodiment of FIG. 7. In a preferred, non-exclusive embodiment, like the first anti-friction elements 27', also the second anti-friction elements 17' may have generally circular shape, with a diameter coinciding with the second thickness S2.

Appropriately, the second inserts 17 may lie on the inner surface 13 only in correspondence of the rear zone 12 of the band 10, so as to come into contact with the skin of the back of the user, or in correspondence of both the front and rear zones 12, 11 of the elastic band 10, so as to act on the skin of the back as well as on the skin of the breast of the user.

In a preferred, non-exclusive embodiment, the inner surface 22 of each cup 20 may include one or more third inserts 28 made in a third flexible polymeric material, which may be the same or in any case have the same base of the first and/or second polymeric material of the first insert 17 and/or of the second inserts 27.

Preferably, each bra will include a single third insert 28, positioned in correspondence of the peripheral edge 42 thereof, in this way, there will be a still greater stability of the bra 1.

More in particular, the third insert 28 acts synergistically with the first insert 27 and/or with the second inserts 17. The lower the quantity of first polymeric material in the cup 20 and/or second polymeric material on the band 10, the greater is the need that the cup 20 also includes the third insert 28. Of course, the greater the size of the breast to be supported is, and therefore the bra size, the greater this need is.

Without being bound by theory, it is possible to state that if the surface occupied by the first inserts 27 with respect to the total inner surface 22 of each cup 20 is less than 20% and the surface occupied by the second inserts 17 with respect to the inner surface 13 of the total elastic band 10 is less than 25%, the cup 20 should also include the third insert 28.

Appropriately, the peripheral edge 42 of each cup 20 may include a lower portion 43 destined to come into contact with the lower part of the breast of the user, an upper inner portion 44 destined to come into contact with the upper inner part of the breast facing the other breast and an upper outer portion 45 destined to come into contact with the upper outer part of the breast opposite to the upper inner part.

Advantageously, the third insert 28 may extend for at least for the lower portion 43 and for the upper inner portion 44 of the peripheral edge 42, as illustrated for instance in FIG. 6, and possibly also for the upper outer portion 45 thereof, as shown for example in FIGS. 2, 4 and 5.

In a preferred, non-exclusive embodiment, the third insert 28 may include, respectively consist of, a third linear element.

This last one, in turn, may include, respectively consist of, a third continuous strip of the third flexible polymeric material, as illustrated in FIGS. 2 and 4, or of a sequence of third anti-friction elements 28' discontinuous with each other made of the third polymeric material and distributed along the peripheral edge 42, as illustrated for example in FIGS. 5 and 6.

Advantageously, the third linear element 28 may have a third thickness S3 comprised between 1 mm and 10 mm, preferably between 1 mm and 5 mm.

In a preferred, non-exclusive embodiment, like the first anti-friction elements 27' and/or of the second anti-friction elements 17''', also third anti-friction elements 28' may have generally circular shape, with a diameter coinciding with the third thickness S3.

To ensure an optimum aesthetic appearance, each of the first inserts 27 may have such a maximum height H with respect to the inner surface 22 of the respective cup 20 that the outer surface 21 of the cups 20 has no protrusions visible from the outside, once the user has worn the bra 1.

Advantageously, the maximum height H may be less than 3 mm, preferably less than 2 mm and even more preferably less than 1 mm. Ideally, the maximum height H may be close to 0.5 mm.

Preferably, the maximum height H may be the same as the second inserts 17 and/or the third inserts 28.

Always for aesthetic purposes, each of the cups 20 may have a smooth outer surface 21, free of cuts and/or seams. Preferably, the cups 20 may be preformed in order to support the breast without compressing it. Advantageously, furthermore, the cups 20 may have minimum elasticity.

Each cup 20 may present a padding 29 interposed between one or more inner layers 40 of the first textile material and one or more outer layers 41 made in a third textile material, which may be equal to the first and/or the second textile material, for example cotton, polyester or a mixed material.

The inner surface of the inner layer 40 may coincide with the inner surface 22 of the cups 20, while the outer surface of the outer layer 41 may coincide with the outer surface 21 of the cups 20.

Advantageously, the padding 29 may have a maximum thickness S of less than 10 mm, preferably less than 8 mm.

In a preferred, non-exclusive embodiment, the elastic band 10 and/or the elongated supporting elements 30 may have an elasticity measured according to ASTM D 2594 greater than that of the cups 20 and/or of the central band 15.

Advantageously, moreover, the peripheral edges 42 of the cups 20 may have an elasticity measured according to ASTM D 2594 greater than that of the cups 20, The first insert 21 and/or the second inserts 17 and/or the third insert 28 may be made on the respective surfaces by means of any technique known to the person skilled in the art.

The above description clearly shows that the invention fulfils the intended objects, in particular the one of supporting the breast while maintaining the natural appearance and the volume, that is, without compressing or otherwise deforming it.

In addition, thanks to the combination of two or more of the above features, the brassiere according to the invention is also aesthetically pleasing even when wearing tight clothing.

The brassiere according to the invention is susceptible of numerous modifications and variations. All the details may be replaced by other technically equivalent elements, and the materials may be different depending on the requirements, without departing from the scope of the invention defined by the appended claims.

The invention claimed is:

1. A bra comprising:

an elastic band configured to encircle a thorax of a user and comprising a front zone for contacting the chest of the user and a rear zone for contacting the back of the user;

a couple of cups each configured to hold a breast of the user, each cup having an upper portion and a lower portion connected to the elastic band in correspondence of the front zone thereof, a central band for mutual connection of the cups being provided; and a couple of elongated flexible support elements each configured to come at least partly in contact with a shoulder of the user, each supporting element including a first end connected to the upper portion of the respective cup and a second end connected to the elastic band at a rear zone thereof, each of the support elements being of adjustable length so as to adapt the bra to the body of the user, the support elements being configured to be disposed substantially parallel to each other during use, wherein each of the cups includes an outer surface and an inner surface configured to contact the skin of the breast and made of a first textile material, the inner surface of each of the cups including a plurality of first inserts spread over an entire inner surface of each of the cups, the first inserts being made of a first flexible polymer material selected among the group consisting of silicones and having a friction coefficient with the skin higher than the first textile material, the first inserts including first linear elements spaced apart from each other and disposed on the inner surface of each of the cups, the first linear elements having a first width of 1 mm to 5 mm, wherein the elastic band includes an inner surface configured to come in contact with the skin of the user and made of a second textile material, the inner surface of the elastic bands including at least one second insert made of a second flexible polymeric material and disposed laterally to the thorax at least at the rear zone of the elastic band, the second flexible polymer material having a friction coefficient with the skin higher than the second textile material so as to minimize a movement thereof relative to the back of the user, wherein the first inserts have a maximum height outward of the inner surface of each of the cups of less than 1 mm when the cups are not worn, so as to provide a uniform profile to the outer surface of each of the cups during the use of the bra, the first linear elements having a polar uniform distribution around a substantially central point of each of the cups to maximize friction on the skin while providing a transpiration thereof, wherein the inner surface of each of the cups includes at least one third insert at a peripheral edge thereof, wherein the peripheral edge of each of the cups includes a lower portion configured to come in contact with a lower part of the breast of the user, wherein the peripheral edge of each of the cups further includes an upper inner portion configured to come in contact with an upper part of the inner surface of the breast facing the other breast and an outer upper portion configured to come in contact with an outer upper part of the breast opposite to the inner upper part thereof, and wherein the at least one third insert extends along the lower portion and along the inner upper part of the peripheral edge of each of the cups.

2. The bra according to claim 1, wherein a surface covered by the first inserts is 10% to 70% of the total inner surface of each of the cups.

3. The bra according to claim 1, wherein a surface covered by the first inserts is 10% to 40% of the total inner surface of each of the cups.

4. The bra according to claim 1, wherein a surface covered by the first inserts is 15% to 35% of the total inner surface of each of the cups.

5. The bra according to claim 1, wherein the first linear elements consist of first continuous strips of the first flexible polymeric material extending outward of a central axis of each of the cups.

6. The bra according to claim 1, wherein the first linear elements consist of sequences of discontinuous first anti-friction elements made of the first polymeric material and extending outward of a central axis of each of the cups.

7. The bra according to claim 1, wherein the elastic band has an elasticity measured according to ASTM D 2594 of less than 80%.

8. The bra according to claim 1, wherein the elastic band has an elasticity measured according to ASTM D 2594 of less than 60%.

9. The bra according to claim 1, wherein the rear zone of the elastic band has a minimum height greater than 40 mm.

10. The bra according to claim 1, wherein the rear zone of the elastic band has a minimum height greater than 50 mm.

11. The bra according to claim 1, wherein the inner surface of the elastic band includes a plurality of second inserts including at least one pair of second linear elements at upper and lower edges of the elastic band, the second linear elements having a second width of 1 mm to 5 mm.

12. The bra according to claim 11, wherein the second linear elements consist of second continuous strips of the second flexible polymeric material lying along the upper and lower edges of the elastic band.

13. The bra according to claim 11, wherein the second linear elements consist of sequences of discontinuous second anti-friction elements made of the second polymeric material lying along the upper and lower edges of the elastic band.

14. The bra according to claim 13, wherein the second polymeric material is the same as the first polymeric material.

15. The bra according to claim 11, wherein the at least one third insert is made of a third flexible polymeric material having a friction coefficient with the skin higher than the first textile material of the inner surface.

16. The bra according to claim 15, wherein a surface covered by the first inserts with respect to the total inner surface of each cup is less than 20% and the surface covered by the second inserts with respect to the total inner surface of the elastic band is less than 25%.

17. The bra according to claim 1, wherein the at least one third insert further extends along the outer upper portion of the peripheral edge of each of the cups.

18. The bra according to claim 1, wherein the at least one third insert consists of a third linear element having a third width of 1 mm to 5 mm.

19. The bra according to claim 18, wherein the third linear element consists of a third continuous strip of the third flexible polymeric material laying along the peripheral edge of each of the cups.

* * * * *